US007767838B2

(12) United States Patent
Sawada et al.

(10) Patent No.: US 7,767,838 B2
(45) Date of Patent: Aug. 3, 2010

(54) PROCESS FOR PRODUCING A MONOGLYCERIDE-CONTAINING COMPOSITION

(75) Inventors: Hiroki Sawada, Wakayama (JP); Jiro Hashimoto, Wakayama (JP); Haruya Mino, Wakayama (JP); Toshitsugu Maeda, Wakayama (JP)

(73) Assignee: Kao Corporation, Tokyo (JP)

( * ) Notice: Subject to any disclaimer, the term of this patent is extended or adjusted under 35 U.S.C. 154(b) by 902 days.

(21) Appl. No.: 10/558,156

(22) PCT Filed: Jun. 3, 2004

(86) PCT No.: PCT/JP2004/008081

§ 371 (c)(1),
(2), (4) Date: Dec. 13, 2006

(87) PCT Pub. No.: WO2004/108872

PCT Pub. Date: Dec. 16, 2004

(65) Prior Publication Data

US 2007/0129560 A1 Jun. 7, 2007

(30) Foreign Application Priority Data

Jun. 6, 2003 (JP) ..... 2003-162065
Jun. 6, 2003 (JP) ..... 2003-162066

(51) Int. Cl.
*C11C 3/00* (2006.01)

(52) U.S. Cl. ..... 554/172; 554/168; 554/173

(58) Field of Classification Search ..... 554/168, 554/172, 173
See application file for complete search history.

(56) References Cited

U.S. PATENT DOCUMENTS

| | | | |
|---|---|---|---|
| 2,206,167 | A | 7/1940 | Edeler et al. |
| 2,474,740 | A | 6/1949 | Ittner et al. |
| 2,478,354 | A | 8/1949 | Allen et al. |
| 2,628,967 | A | 2/1953 | Voegeli et al. |

FOREIGN PATENT DOCUMENTS

| | | | |
|---|---|---|---|
| JP | 1-268663 | A | 10/1989 |
| JP | 9-87231 | A | 3/1997 |
| JP | 2003-252829 | A | 9/2003 |

*Primary Examiner*—Porfirio Nazario-Gonzalez
*Assistant Examiner*—Yate' K Cutliff
(74) *Attorney, Agent, or Firm*—Birch, Stewart, Kolasch & Birch, LLP

(57) ABSTRACT

The invention provides a process for producing a monoglyceride-containing composition by reacting glycerin with at least one kind of acyl-containing compound selected from fatty acid and glycerin ester, the reaction being conducted with a catalyst containing at least one metal selected from iron, cobalt and manganese in an amount of 0.1 to 60 ppm in terms of metal (weight ratio to the total weight of glycerin and the acyl-containing compound), as well as a process for producing a monoglyceride-containing composition by reacting glycerin with at least one kind of acyl-containing compound selected from fatty acid and glycerin ester, including a step of maintaining the amount of water at 500 to 5000 ppm in the reaction system after the degree of conversion in the reaction of glycerin with fatty acid reaches 90% or more based on the fatty acid, or during the ester exchange reaction of glycerin with glycerin ester.

12 Claims, No Drawings

PROCESS FOR PRODUCING A MONOGLYCERIDE-CONTAINING COMPOSITION

FIELD OF THE INVENTION

The present invention relates to a process for producing a monoglyceride-containing composition having a high monoglyceride content.

BACKGROUND OF THE INVENTION

Monoglycerides used widely as surfactants and the like in cosmetics, foods, and industrial emulsifiers or lubricants are produced by esterification reaction of glycerin with fatty acid or by ester exchange reaction of glycerin with fat and oil. These reactions are carried out in the absence or presence of a catalyst, and generally a mixture of glycerin, monoglyceride, diglyceride and triglyceride is formed. The reaction system is usually a heterogeneous system, and the amount of monoglycerides formed is influenced by the solubility of glycerin in a fatty acid phase or a formed ester phase, and thus even if the amount of glycerin charged is merely increased, the content of monoglyceride cannot be increased. Accordingly, when higher performance (that is, high-purity) monoglycerides are to be obtained, purification by molecular distillation is carried out.

U.S. Pat Nos. 2,474,740 and 2,478,354 disclose a method of accelerating the ester exchange reaction of 5 to 15% water-containing glycerin with fat and oil in the absence of a catalyst.

U.S. Pat. No. 2,206,167 discloses a process for producing monoglycerides from glycerin and fats and oils by ester exchange reaction using an alkali (Na etc.) soap as a catalyst.

U.S. Pat. No. 2,628,967 discloses a process for producing monoglycerides by reacting glycerin or ethylene glycol with fatty acid or glycerin polyester at high temperatures in the presence of a specific transition metal (iron etc.) catalyst.

SUMMARY OF THE INVENTION

The present invention provides a process for producing a monoglyceride-containing composition, including reacting glycerin with at least one kind of acyl-containing compounds selected from a fatty acid and a glycerin ester, using a catalyst containing at least one metal selected from iron, cobalt and manganese in an amount of 0.1 to 60 ppm in terms of metal as a weight ratio thereof to the total weight of glycerin and the acyl-containing compound.

Further, the present invention provides a process for producing a monoglyceride-containing composition, including reacting glyceride with at least one kind of acyl-containing compounds selected from a fatty acid and a glycerin ester, wherein the amount of water at 500 to 5000 ppm is maintained in the reaction system after the degree of conversion in the reaction of glycerin with fatty acid reaches 90% or more based on the fatty acid, or during the ester exchange reaction of glycerin with glycerin ester.

DETAILED DESCRIPTION OF THE INVENTION

U.S. Pat. Nos. 2,474,740 and 2,478,354 have a problem that the system is a pressurized system for maintaining the amount of water, and also that the unreacted fatty acid remains in a considerable amount.

U.S. Pat. No. 2,206,167 has a problem that when the unreacted glycerin is removed by distillation after the reaction, the alkali should previously be neutralized at high temperatures in order to prevent the content of monoglyceride from being decreased due to reverse reaction, and also that a neutral salt which cannot be separated even by filtration remains in the product.

U.S. Pat. No. 2,628,967 has a problem that although neutralization of the catalyst is not necessary, the amount of the catalyst used is 80 to 1700 ppm in terms for metal, thus making the product hardly usable as it is owing to a large amount of insolubles, and also that because reverse reaction upon removal of glycerin by distillation promotes reduction in the content of monoglyceride, the catalyst should previously be removed by filtration or decantation after cooling. Further, there is a problem that in the filtration, the rate of filtration is lowered due to the remaining glycerin, whereas the decantation results in lower yield. There is also a feature undesirable from the viewpoint of the process that heating should be conducted again to remove the unreacted glycerin by distillation.

The purpose of the present invention is to provide a process for producing a monoglyceride-containing composition having a high content of monoglyceride from glycerin and fatty acid or glycerin ester, without using an expensive concentrator such as a molecular distillation apparatus or a special high-speed stirring shearing machine.

The present invention provides a process for easily producing a monoglyceride-containing composition having a high content of monoglyceride from glycerin and fatty acid or glycerin ester, without using an expensive concentrator such as molecular distillation apparatus or a special high-speed stirring shearing machine.

The glycerin used in the present invention is not particularly limited, but is preferably the one having 95 wt % or more purity.

The acyl-containing compound selected from fatty acid and glycerin ester, used in the present invention, is a compound having any of branched, linear, saturated and unsaturated acyl groups, but from the viewpoint of a more evident effect of the present invention, the number of carbon atoms in the acyl group is preferably 12 to 30, more preferably 14 to 22.

Examples of the fatty acid used in the present invention include a single fatty acid such as lauric acid, myristic acid, palmitic acid, stearic acid, oleic acid, elaidic acid, linoleic acid, linolenic acid etc., or mixed fatty acid such as soybean oil fatty acid, rapeseed oil fatty acid, tall oil fatty acid etc. From the viewpoint of low-temperature fluidity relating to handling of the monoglyceride-containing composition, the fatty acid is preferably the one having an iodine value of 80 or more, more preferably 130 or more. Preferable examples of such fatty acid include oleic acid, linoleic acid, linolenic acid, soybean oil fatty acid, rapeseed oil fatty acid and tall oil fatty acid.

The glycerin ester used in the present invention includes triester and diester composed of the fatty acid and glycerin, as well as a mixture thereof. The monoester may be contained in the glycerin ester.

From the viewpoint of obtaining a monoglyceride-containing composition having a high content of monoglyceride and improving productivity per batch, the reaction ratio of glycerin to the acyl-containing compound in the present invention is determined such that the amount of glycerin is preferably 1 mole or more, more preferably 1 to 3 moles, still more preferably 1.5 to 3 moles, per mole of the acyl group in the acyl-containing compound.

A catalyst may or may not be used in the present invention, but when used, a catalyst containing at least one metal selected from iron, cobalt and manganese is preferable, and such catalyst includes a metal element selected from iron, cobalt and manganese, or a compound thereof. Specifically, the iron-containing catalyst includes a reduced iron element, oxides and hydroxides such as iron sesquioxide ($Fe_2O_3$), tri-iron tetroxide ($Fe_2O_4$), iron hydroxide (FeOH) etc., metal soaps such as iron acetate, iron proprionate, iron stearate, iron oleate etc., and chlorides such as iron chloride(II), iron chloride(III) etc. The cobalt-containing catalyst includes a cobalt element, cobalt monoxide (CoO), tricobalt tetroxide ($Co_3O_4$), cobalt carbonate, cobalt stearate, cobalt chloride(II) and the like. The manganese-containing catalyst includes a manganese element, manganese dioxide, trimanganese tetroxide, manganese stearate and the like. From the viewpoint of catalytic activity, handling properties and availability, the catalyst is preferably the iron-containing catalyst, particularly preferably iron hydroxide. From the viewpoint of shorter reaction time, less burden on filtration and the like, the amount of the catalyst used is preferably 0.1 to 60 ppm, more preferably 0.5 to 10 ppm, still more preferably 0.5 to 5 ppm in terms of metal.

From the viewpoint of increasing the monoglyceride content and reducing the amount of free fatty acid, the process of the present invention includes a step of regulating the water content of the reaction system in an amount of preferably 500 to 5000 ppm, more preferably 600 to 4000 ppm, still more preferably 600 to 3000 ppm, further more preferably 1000 to 3000 rpm, after the degree of conversion (defined in equation (I) below) in the reaction of glycerin with fatty acid reaches 90% or more based on the fatty acid, to show the predominance of the ester exchange reaction over the esterification reaction, or during the ester exchange reaction of glycerin with glycerin ester. Although the role of water in the process of the present invention is not evident, it is estimated that by water, the glycerin ester is hydrolyzed in a very small amount to release fatty acid which in turn exerts catalytic action on ester exchange.

The amount of water can be regulated by regulating the amount of an inert gas such as nitrogen introduced into a reaction container by introducing the inert gas into a reaction solution and/or a space over the reaction solution, while the amount of water in the reaction solution is measured with time with a water meter. The inert gas is supplied preferably continuously or intermittently. In the reaction coming to be deficient in water, such as in the reaction of glycerin with glycerin ester, the amount of water in the system is regulated in the above range water preferably by adding water previously, if necessary by combination with introduction of an inert gas such as nitrogen into the reaction container.

$$\text{Degree of conversion (\%)}=(1-[\text{weight of unreacted fatty acid}]/[\text{weight of charged fatty acid}])\times 100 \quad \text{(I)}$$

The temperature in the reaction of glycerin with the acyl-containing compound is preferably 180° C. or more from the viewpoint of improving both the solubility of glycerin in an oil layer and the rates of esterification reaction and ester exchange reaction, and is preferably 270° C. or less from the viewpoint of preventing formation of diglycerin as a byproduct. Specifically, the reaction temperature is preferably 180 to 270°0 C., more preferably 200 to 260° C., still more preferably 240° C. to 255° C. When the reaction temperature is 250° C. or more, the reaction time is preferably 12 hours or less, more preferably 7 hours or less, still more preferably 5 hours or less, although the reaction time shall be varied depending on the reaction temperature because heating at high temperatures for a long time leads to an increase in the amount of byproduct diglycerin as a condensate of glycerin.

The monoglyceride-containing composition having a high content of monoglyceride obtained by the process of the present invention can be used as it is, but glycerin, and the metal-containing catalyst when used, are preferably removed. When glycerin and the metal-containing catalyst are removed, it is preferable from the viewpoint of productivity that the glycerin is distilled away in the presence of the metal-containing catalyst. That is, when the metal-containing catalyst is to be filtered off before glycerin is distilled away, the reaction mixture should be cooled once to 100° C. or less before filtration of the catalyst, owing to problems such as the heat resistance of a filtering material and the removability of the catalyst, and then heated again to high temperatures in order to distill glycerin away, thus making the process complicated, but the process of the present invention is free of such complication. Further, in the process involving first distilling glycerin away and then filtering the metal-containing catalyst off, the highly viscous glycerin is not present at the time of filtration, and thus it is also advantageous in that the speed of filtration can be increased. Specifically, after the reaction, the glycerin is distilled away under reduced pressure, and the glycerin is further distilled away if necessary by supplying water vapor under reduced pressure, and then the metal-containing catalyst is removed by filtration.

The glycerin can be distilled away in a batch system or in a continuous system with a thin film distillation apparatus. When the glycerin is distilled away in the batch system, there are employed conditions under which the temperature is preferably 200° C. or less, preferably 180° C. or less, and the pressure is preferably 53 kPa or less, more preferably 2.7 kPa or less. Filtration can be easily carried out with a zeta potential filter having an adsorption action with zeta potential.

The monoglyceride content in the present invention refers to a content determined according to the following equation (II) after GPC analysis (gel permeation chromatography), that is, the ratio by area of monoglyceride to the total of monoglyceride, diglyceride and triglyceride in GPC analysis.

$$\text{Monoglyceride content (area-\%)}=(MG/[MG+DG+TG])\times 100 \quad \text{(II)}$$

MG: Area of monoglyceride in GPC.
DG: Area of diglyceride in GPC.
TG: Area of triglyceride in GPC.

According to the process of the present invention, a monoglyceride-containing composition having a high monoglyceride content of 55 area-% or more can be obtained. From the viewpoint of productivity, the monoglyceride content can be increased to a high content of 75 area-%. Specifically, a composition having a monoglyceride content of 55 to 75 area-%, particularly 60 to 75 area-%, can be produced.

EXAMPLES

The monoglyceride content was determined by GPC analysis. As the columns, TSK gel G2000HXL and TSK gel G1000HXL manufactured by Tosoh Corporation were connected in series, and RI (differential refractometer) was used as the detector, and THF (tetrahydrofuran) was used as the eluent.

The content of glycerin and diglycerin was quantified by GC analysis (gas chromotagraphy), and the content of iron was quantified by ICP analysis (inductively coupled plasma-emission spectrometry).

Example 1

A 2-L four necked flask equipped with a stirrer, a dehydration tube-cooling tube, a thermometer and a nitrogen inlet tube was charged with 480 g glycerin and 750 g tall oil fatty acid [glycerin/fatty acid (molar ratio)=2.0], then iron hydroxide suspended in a small amount of water was added thereto in an amount of 2 ppm in terms of iron, and nitrogen was introduced at 100 mL/min. into a space over the solution, while the solution was heated over about 1.5 hours to 250° C. under stirring at 400 r/min. After 250° C. was reached, the mixture was reacted at that temperature for 4 hours. The acid value, water content and monoglyceride content were analyzed with time, and as a result, the water content was changed in the range of 700 to 1900 ppm when the degree of conversion based on the fatty acid was 90% or more. The monoglyceride content in the product after the reaction was 67 area-%.

Subsequently, the reaction mixture was refluxed under reduced pressure, whereby the mixture was cooled to 170° C., then the glycerin was distilled away at a reduced pressure of 2.7 kPa or less, water vapor was supplied at 150° C. at 2 kPa for 2 hours, and then the product was subjected to adsorption filtration with Zeta Plus 30S (manufactured by Cuno, Inc.) under pressure, to give a monoglyceride-containing composition. The monoglyceride content in the composition was 64 area-%, the acid value was 2.0 mg KOH/g, the glycerin content was 0.3 wt-%, the diglycerin content was 0.3 wt-%, and the iron content was 0.1 ppm or less.

Example 2

The reaction was carried out in the same manner as in Example 1 except that iron stearate was used in place of iron hydroxide, and the glycerin was removed and adsorption filtration was conducted in the same manner. The monoglyceride content in the product after the reaction was 65 area-%, and the water content was changed in the range of 600 to 1300 ppm when the degree of conversion based on the fatty acid was 90% or more. The monoglyceride content in the composition after the adsorption filtration was 62 area-%, the acid value was 0.2 mg KOH/g, the glycerin content was 0.4 wt-%, the diglycerin content was 0.4 wt-%, and the iron content was 0.1 ppm or less.

Example 3

The reaction was carried out in the same manner as in Example 1 except that nitrogen was blown at 100 mL/min. into the solution, and the reaction was carried out for 6 hours. The glycerin was removed and adsorption filtration was conducted in the same manner. The monoglyceride content in the product after the reaction was 63 area-%, and the water content was changed in the range of 300 to 400 ppm when the degree of conversion based on the fatty acid was 90% or more. The monoglyceride content in the composition after the adsorption filtration was 61 area-%, the acid value was 0.3 mg KOH/g, the glycerin content was 0.4 wt-%, the diglycerin content was 0.5 wt-%, and the iron content was 0.1 ppm or less.

Example 4

The reaction was carried out in the same manner as in Example 1 except that iron chloride(II) $4H_2O$ was used in place of iron hydroxide and added in an amount of 10 ppm in terms of iron, and the glycerin was removed and adsorption filtration was conducted in the same manner. The monoglyceride content in the product after the reaction was 66 area-%, and the water content was changed in the range of 600 to 1500 ppm when the degree of conversion based on the fatty acid was 90% or more. The monoglyceride content in the composition after the adsorption filtration was 63 area-%, the acid value was 0.2 mg KOH/g, the glycerin content was 0.5 wt-%, the diglycerin content was 0.3 wt-%, and the iron content was 0.1 ppm or less.

Example 5

The reaction was carried out in the same manner as in Example 1 except that soybean oil was used in place of tall oil fatty acid and charged in such an amount that the amount of glycerin was 2 moles per mole of acyl group in the soybean oil, and iron hydroxide was added in an amount of 10 ppm in terms of iron, and the reaction time was changed to 10 hours. The glycerin was removed and adsorption filtration was conducted in the same manner. The monoglyceride content in the product after the reaction was 64 area-%, and the water content was changed in the range of 600 to 1400 ppm when the degree of conversion based on the fatty acid was 90% or more. The monoglyceride content in the composition after the adsorption filtration was 61 area-%, the acid value was 0.4 mg KOH/g, the glycerin content was 0.4 wt-%, the diglycerin content was 0.9 wt-%, and the iron content was 0.1 ppm or less.

Example 6

A 2-L four-necked flask equipped with a stirrer, a dehydration tube-cooling tube, a thermometer and a nitrogen inlet tube was charged with 480 g glycerin and 750 g tall oil fatty acid [glycerin/fatty acid (molar ratio)=2.0], and nitrogen was introduced at 100 mL/min. into a space over the solution in the flask, while the solution was heated over about 1.5 hours to 250° C. under stirring at 400 rpm. After 250° C. was reached, the mixture was reacted at that temperature for 6 hours. The acid value, water content and monoglyceride content were analyzed with time, and as a result, the degree of conversion based on the fatty acid upon reaching 250° C. was 93%, the water content at a degree of conversion of 90% or more based on the fatty acid was 700 to 2200 ppm, the degree of conversion upon conclusion of the reaction was 99%, and the monoglyceride content was 61 area-%.

Example 7

The reaction was carried out in the same manner as in Example 6 except that nitrogen was blown at 30 mL/min. into the solution, and the reaction was carried out at 250° C. for 6 hours. The degree of conversion based on the fatty acid upon reaching 250° C. was 93%, the water content at a degree of conversion of 90% or more based on the fatty acid was 600 to 900 ppm, the degree of conversion upon conclusion of the reaction was 99%, and the monoglyceride content was 60area-%.

Comparative Example 1

The reaction was carried out in the same manner as in Example 3 except that iron hydroxide was not added, and the glycerin was removed and adsorption filtration was conducted in the same manner. The monoglyceride content in the product after the reaction was 54 area-%, and the water content was changed in the range of 300 to 400 ppm when the degree of conversion based on the fatty acid was 90% or more. The monoglyceride content in the composition after the adsorption filtration was 51 area-%, the acid value was 0.3 mg KOH/g, the glycerin content was 0.4 wt-% and the diglycerin content was 0.7 wt-%.

Comparative Example 2

The reaction was carried out in the same manner as in Example 3 except that sodium hydroxide was used in place of iron hydroxide and added in an amount of 10 ppm in terms of sodium, and the glycerin was removed by distillation under reduced pressure without neutralization. The monoglyceride content in the product after the reaction was 62 area-%, and the water content was changed in the range of 300 to 400 ppm when the degree of conversion based on the fatty acid was 90% or more. The monoglyceride content in the composition after glycerin distillation was 48 area-%, the glycerin content was 3.1 wt-% and the diglycerin content was 0.7 wt-%.

Comparative Example 3

The reaction was carried out in the same manner as in Example 6 except that nitrogen was blown at 100 mL/min. into the solution, and the reaction was carried out at 250° C. for 6 hours. The degree of conversion based on the fatty acid upon reaching 250° C. was 94%, the water content at a degree of conversion of 90% or more based on the fatty acid was 300 to 400 ppm, the degree of conversion upon conclusion of the reaction was 99%, and the monoglyceride content was 54 area-%.

The invention claimed is:

1. A process for producing a monoglyceride-containing composition, comprising the steps of:

reacting glycerin with at least one kind of an acyl-containing compound selected from the group consisting of a fatty acid and a glycerin ester, using a catalyst comprising at least one metal selected from the group consisting of iron, cobalt and manganese in an amount of 0.1 to 60 ppm in terms of metal as a weight ratio thereof to the total weight of the glycerin and the acyl-containing compound; and maintaining the amount of water at 500 to 5000 ppm in the reaction system after the degree of conversion in the reaction of glycerin with fatty acid reaches 90% or more based on the fatty acid, or during the ester exchange reaction of glycerin with glycerin ester.

2. The process according to claim 1, wherein at least one mole of glycerin is used and reacted with 1 mole of the acyl group in the acyl-containing compound.

3. The process according to claim 1, wherein glycerin is reacted with the acyl-containing compound and then the glycerin is distilled away in the presence of the metal-containing catalyst.

4. The process according to claim 1, wherein the metal is iron.

5. The process according to claim 1, wherein the number of carbon atoms in the acyl group in the acyl-containing compound is 12 to 30.

6. The process according to claim 1, wherein the reaction temperature is 180 to 270° C.

7. The process according to claim 1, wherein the monoglyceride content in the monoglyceride-containing composition as determined by GPC analysis is 55 area-% or more.

8. A process for producing a monoglyceride-containing composition, comprising the step of reacting glycerin with at least one kind of an acyl-containing compound selected from the group consisting of a fatty acid and a glycerin ester, wherein the amount of water is maintained at 500 to 5000 ppm in the reaction system after the degree of conversion in the reaction of glycerin with fatty acid reaches 90% or more based on the fatty acid, or during the ester exchange reaction of glycerin with glycerin ester.

9. The process according to claim 8, wherein at least 1 mole of glycerin is used and reacted with 1 mole of acyl group in the acyl-containing compound.

10. The process according to claim 8, wherein the number of carbon atoms in the acyl group in the acyl-containing compound is 12 to 30.

11. The process according to claim 8, wherein the reaction temperature is 180 to 270° C.

12. The process according to claim 8, wherein the monoglyceride content in the monoglyceride-containing composition as determined by GPC analysis is 55 area-% or more.

* * * * *